US005547548A

United States Patent [19]

Siddoway

[11] Patent Number: 5,547,548

[45] Date of Patent: Aug. 20, 1996

[54] PYROLYSIS PROCESS WATER UTILIZATION

[75] Inventor: Mark A. Siddoway, Destrehan, La.

[73] Assignee: Tek-Kol, LaJolla, Calif.

[21] Appl. No.: 276,319

[22] Filed: Jul. 18, 1994

[51] Int. Cl.[6] ..... C10B 21/18; C10L 5/00; C10G 1/00

[52] U.S. Cl. ..... 201/29; 201/28; 201/39; 44/620; 44/626; 208/427

[58] Field of Search ..... 201/28, 29, 39; 44/620, 621, 625, 626; 208/404, 427

[56] References Cited

U.S. PATENT DOCUMENTS

| | | | |
|---|---|---|---|
| 1,973,913 | 9/1934 | Sperr Jr. | 202/37 |
| 2,650,190 | 8/1953 | Steinschlaeger | 202/30 |
| 3,112,255 | 11/1963 | Campion | 208/11 |
| 3,487,001 | 12/1969 | Needham | 208/11 |
| 3,520,795 | 7/1970 | Schulman et al. | 208/11 |
| 3,565,784 | 12/1968 | Schlinger et al. | 208/11 |
| 4,009,080 | 2/1977 | Kurokawa et al. | 201/39 R |
| 4,100,034 | 7/1978 | Smith et al. | 201/39 |
| 4,104,129 | 8/1978 | Fields et al. | 201/17 |
| 4,108,731 | 8/1978 | Palumbo et al. | 201/28 X |
| 4,145,256 | 3/1979 | Bowen | 202/25 |
| 4,284,476 | 8/1981 | Wagener et al. | 201/39 |
| 4,396,394 | 8/1983 | Li et al. | 044/1 |
| 4,402,706 | 9/1983 | Wunderlich | 44/1 |
| 4,419,185 | 12/1983 | Bowen et al. | 201/4 |
| 4,475,986 | 10/1984 | Smith | 201/7 |
| 4,505,809 | 3/1985 | Brunner | 208/11 |
| 4,511,363 | 4/1985 | Nakamura et al. | 44/1 |
| 4,523,927 | 6/1985 | Kuge et al. | 44/620 X |
| 4,559,060 | 12/1985 | Muroi et al. | 44/23 |
| 4,597,776 | 7/1986 | Ullman et al. | 48/197 |
| 4,664,750 | 5/1987 | Biesheuvel et al. | 201/1 |
| 4,725,337 | 2/1988 | Greene | 44/626 |
| 4,741,837 | 5/1988 | Schweizer et al. | 44/620 X |
| 4,792,382 | 12/1988 | Lorenz et al. | 201/3 |
| 4,797,136 | 1/1989 | Siddoway et al. | 44/501 |
| 4,802,573 | 2/1989 | Holter et al. | 201/39 |
| 4,828,575 | 5/1989 | Bellows et al. | 44/501 |
| 5,059,307 | 10/1991 | Meyers et al. | 208/404 |
| 5,087,269 | 2/1992 | Cha et al. | 44/626 |
| 5,322,530 | 6/1994 | Merriam et al. | 44/608 |

*Primary Examiner*—Robert J. Warden
*Assistant Examiner*—Christopher Kim
*Attorney, Agent, or Firm*—Polster, Lieder, Woodruff & Lucchesi, L.C.

[57] ABSTRACT

A method for reducing the undesirable contaminants in process water produced in pyrolysis of low rank coal. The method uses the process water to quench and rehydrate a char produced by pyrolysis with the contaminants in the waster water being absorbed by the char.

12 Claims, 2 Drawing Sheets

PYROLYSIS PROCESS WATER UTILIZATION

BACKGROUND OF THE INVENTION

This invention relates to a process for producing a particulate fuel from coal having a reduced water content while economically using process water that is produced during processing. The fuel can be dried subbituminous coal or a pyrolyzed coal, also known as char or pyrolyzed carbonaceous materials. Hereinafter, the term char shall apply to ambient and dried coal, the really dried coal, or pyrolyzed coal, or other appropriate carbonaceous material.

Many of the coal deposits in the United States that are easily mined are referred to as low rank coals, i.e., coals that contain a considerable quantity of inherent moisture (ASTM D 121-73) and have relatively low specific heating values. These coals are desirable as fuels, but the cost of transporting them to coal burning facilities is high due to their water content. The high water content also lowers the efficiency of the coal burning facility since the water has to be evaporated in the conversion to thermal energy. While these coals are expensive to transport long distances, many are very desirable because they have relatively low sulfur contents and may not require extensive equipment for removing sulfur from the stack gases when they are burned. In addition, the coals normally are inexpensive to mine by surface procedures since they are located relatively near the surface of the earth, especially in the Western states.

The Western low rank coals typically contain 20–40 perent water by weight and have a heating value of approximately 7000–9000 BTU per pound. In contrast, if the coal's typical water content can be lowered to 4 to 7 percent by weight, then the heating value of 8000 Btu/lb, 30% water by weight coal can be increased to 12,000 BTU per pound, or more by the appropriate processing. From these figures, it can be seen that the value of the coal can be increased substantially if an economical process can be developed for removing the water from the coal. In addition to removing the water from the coal, the process also must provide for the use or disposal of any water generated by the process i.e. process water. This process water can contain substances which make it difficult to dispose of the water in conventional watersheds. When a coal's temperature is raised to temperatures in excess of about 600° F., some hydrocarbons are driven off the coal, which include phenols and water soluble hydrocarbons. The process water contains these hydrocarbons. These products obviously must be removed from the process water before the process water can be disposed of in conventional watersheds or released into the atmosphere. Alternatively, the water can be used in the process as described below.

SUMMARY OF THE INVENTION

The present invention solves the above problems by providing an economical process for using the process water. In the first step of the process, the coal is dried in a low temperature dryer to remove most of the water including both the surface water and the water contained in the pore spaces of the coal. The coal exits from the first step, and its temperature is raised further. This changes the character of the coal so that is will not resorb substantial amounts of the water that has been removed. This is accomplished in the second step by mildly pyrolyzing the coal to change its chemical makeup.

In the pyrolyzing step, the remaining water is removed and hydrocarbons and other gases are released due to the relatively high temperature of the pyrolyzing step. The pyrolyzed coal, referred to now as char or pyrolyzed carbonaceous material, exits from the pyrolyzer and passes to a quenching step where it is quenched to reduce its temperature to less than about 500° F. Conventional or process water can be used in the quenching step because the vapor will either be condensed or passed to a combustor. The water from the quenching step is passed to a condenser where it is partially condensed into a liquid form which becomes process water. The pyrolyzed coal passes from the quenching step to an oxidizing zone where it is partially oxidized to prevent spontaneous combustion. The pyrolyzed coal passes from the oxidizing step to a cooling and rehydrating step where process water condensed from the quenching step is recombined with the pyrolyzed coal or char.

In general, process water containing hydrocarbons can be generated in other parts of the process as well as the quenching/water condensation step. For example condensed water from the drying and pyrolyzing units, in oil recovery vessels, water separated from oil emulsions, water generated when steaming or cleaning vessels, seal water used to isolate process vessels from the atmosphere and water used for slurrying coal fines all come in contact with hydrocarbons and become process water. This process water would become a serious waste disposal problem and an oil/water separation problem were it not for the present invention.

In addition to the process water recombining with the char, the liquid hydrocarbons, phenolics and water soluble hydrocarbons also recombine with the char. The char, as it exits from the rehydrating zone, contains approximately 1 to 15 percent water by weight and most preferably 4–7% water by weight and has a heating value of approximately 12,000 BTU per pound. Such rehydration stabilizes the solid product by preventing further uncontrolled rehydration and by decreasing the tendency of the char to spontaneously ignite.

In certain cases, which will depend on the properties of the char and the amount of water added, further cooling after the rehydration step may be needed due to the heat released by the rehydration and/or the temperature of the water added and the char temperature. The rehydrating step combines the phenols, water soluble hydrocarbons and the liquid hydrocarbons with the coal in a manner that retains the material in the char even under elevated temperature or when subjected to the leaching action of water. Thus, the char or carbonaceous material can be transported and stored in a conventional manner without danger of the hydrocarbons or phenolics being removed from the char either by exposure to moderate temperatures or leached by being exposed to rain storms. In addition, as a result of the pyrolyzing step, the char becomes more hydrophobic than the parent coal and will not resorb the water that has been removed in the drying process. The char, when burned in a conventional boiler, for example, will also cause incineration of the phenolics and the hydrocarbons that have been added in the rehydrating step. Thus, the hydrocarbons in the process water from the pyrolyzer will be economically disposed of by recombing them with the char and increasing its heating value.

Depending on the degree of rehydration, a dust suppression agent may be added to the char after rehydration. If rehydration is to the extent that free or surface water is present on the char after the rehydration process has stabilized, the char will need little or no dust suppression treatment. However, if there is no free water on the char after rehydration (caused by the char having sufficient porosity to absorb all rehydration water into the pores), treatment for dust suppression will be required.

While the preferred embodiment of disposing of process water is described above, any coal pyrolysis process can utilize hydrocarbon containing process water on the char due to the discovered affinity for hydrocarbons contained in the water by the resulting char.

BRIEF DESCRIPTION OF THE DRAWING

The invention will be more easily understood when taken in conjunction with the following description and the attached drawings showing, in block diagram form, the process of the invention.

DESCRIPTION OF THE PREFERRED EMBODIMENTS

Figure 1:
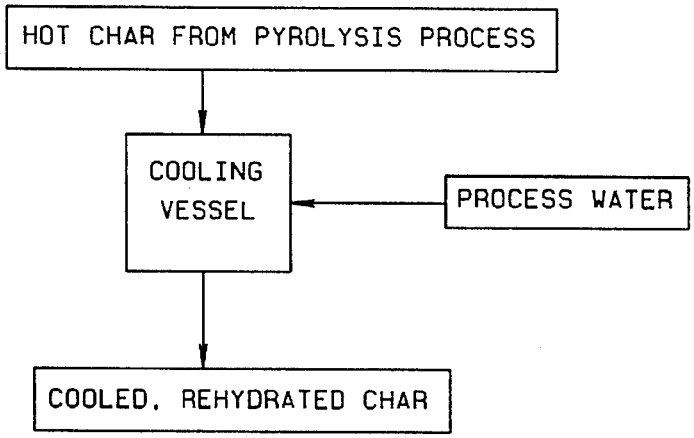
FIG. 1 is a block diagram illustrating a portion of the method of the present invention.

As shown in FIG. 1, char from a pyrolysis process at 300–500 F. enters a cooling vessel. In the cooling vessel, it is combined with process water when its temperature is less than about 170F. The process water then sorbs into the char releasing heat. The heat is released to the cooling vessel, and the char exits the process below 200 F., preferably less than 100F.

Figure 2:
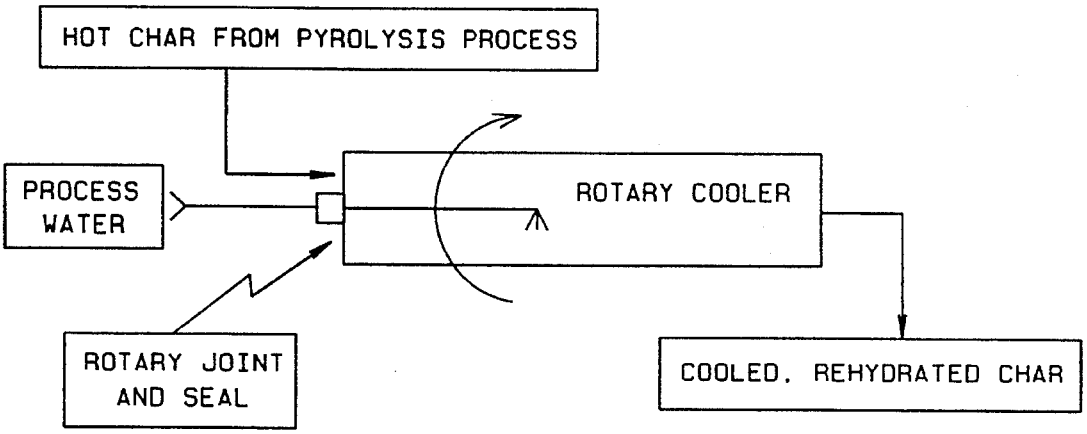
FIG. 2 is a block diagram illustrating a portion of the method of the present invention.

As shown in FIG. 2, char from a pyrolysis process at 300–500 F. enters a rotary cooling vessel. In the rotary cooler, the char is combined with process water when its temperature is less than about 170 F. The process water then sorbs into the char releasing heat. Heat from rehydration is released to the rotary cooler, and the char exits the process below 200 F., preferably less than 100 F.

Figure 3:
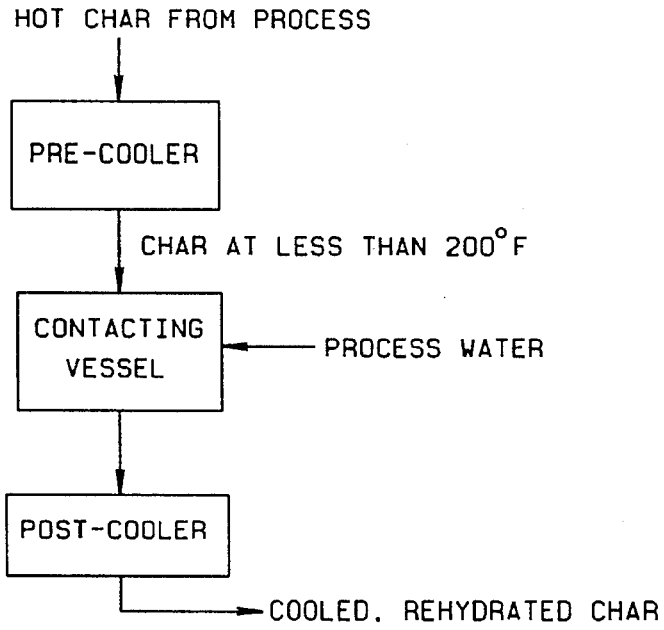
FIG. 3 is a block diagram illustrating a portion of the method of the present invention.

As shown in FIG. 3, char from a pyrolysis process at 300–500 F. is cooled to less than about 170 F. in a cooling vessel. The char is rehydrated and further cooled in a second cooling vessel.

Figure 4:
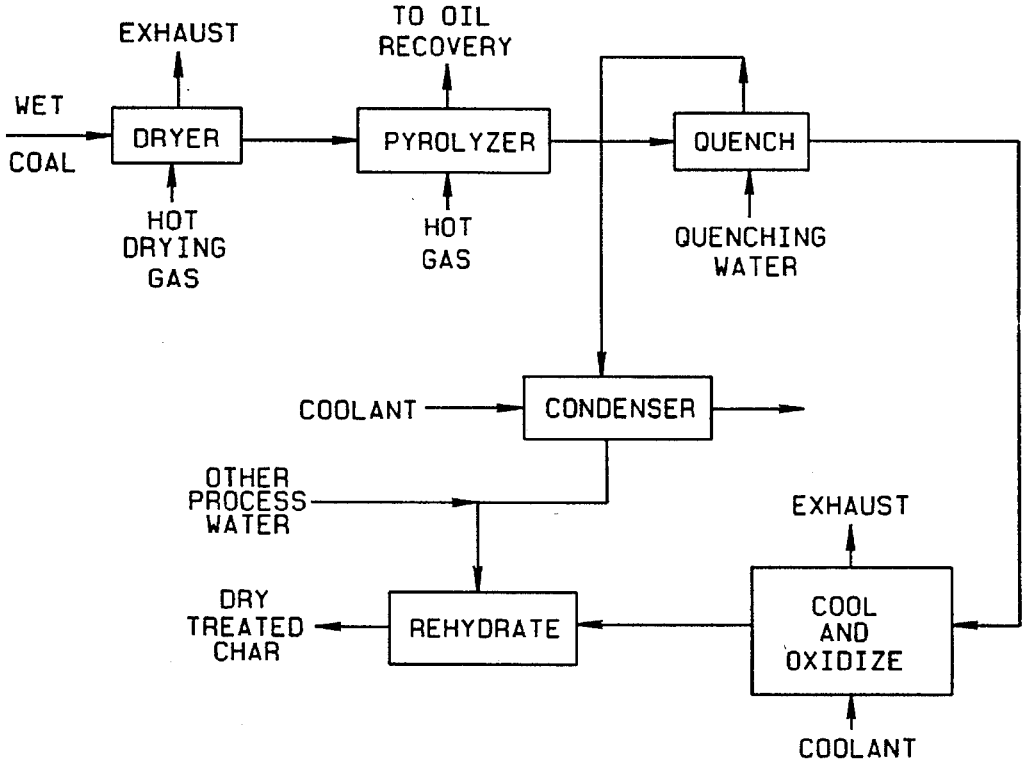
FIG. 4 is a block diagram illustrating the method of the present invention.

Referring now to FIG. 4, the wet coal supplied to the dryer can be any low rank coal but the data refers to a subbituminous coal from Wyoming. This coal contains approximately 30 percent by weight water and has a heating value of 8300 BTU per pound as mined. The coal is supplied to the dryer stage where hot drying gas from a furnace is passed over the coal. The coal, as it exits from the drying stage, contains approximately 0 to 10 percent water, preferably about 3% water by weight. The coal, in the drying stage, is maintained at a relatively low temperature 300°–400° F. The water vapor removed from the coal can be exhausted directly to the atmosphere since, at the low temperatures maintained in the drying stage, none of the hydrocarbons or phenols contained in the coal will be vaporized. The coal, as it exits from the drying stage, will be highly hydrophilic and steps must be taken to change its chemical composition to prevent the reabsorption of the water that has been removed in the drying stage.

The chemical change in the coal structure is provided in the pyrolyzing step wherein the coal is subjected to a hot drying gas but at a temperature considerably higher than the temperature in the drying stage. In particular, the solid temperature in the pyrolyzing stage is raised to between about 800° and 1100° F. In the pyrolyzer, the water remaining in the coal will be driven off and other gases, including hydrocarbons, will be released. These temperatures partially pyrolyze the coal and materially change the chemical nature of the coal. The off-gas from the pyrolyzer reports to an oil recovery system where hydrocarbons are condensed and removed. The solids are now also referred to as char or as pyrolyzed carbonaceous material.

The char exits from the pyrolyzing stage at a temperature of approximately 900° to 1100° F. and passes to the quenching stage. In the quenching stage the char is cooled or quenched by fresh water or process water which will immediately flash to steam that cannot be exhausted directly to the atmosphere because it contains residual hydrocarbons and solid particulates as well as vapor. The char exits the quenching stage at approximately 300°–500° F.

The water vapor and residual vaporized hydrocarbons from the quenching stage are sent to a condenser where they are partially condensed to a liquid form.

The char from the quenching stage passes through a cooling and oxidizing stage wherein the material is directly cooled by a cool gas stream. Also, oxygen is added to the char as it is cooled to partially oxidize the material and reduce its tendency to spontaneously combust.

The char exits from the cooling and oxidizing stage and passes to a rehydrating stage where process water is recombined with the char. A small amount of water, from 1 to 15% by weight, is recombined with the char along with the dissolved or dispersed hydrocarbons. The char enters the rehydrating stage at approximately 170° F. or lower and thus, neither the water nor the hydrocarbons will be flashed to a vapor in this stage. The solid exits from the rehydrating stage as a stable solid fuel preferably at 100° F. or less and having approximately 4 to 7 percent moisture and a heating value of 12,000 BTU per pound. At the preferred moisture content there will be no surface moisture so the rehydrated char is treated with a dust suppression agent after the rehydration step.

Referring to Table I below, Example (1) shows the pilot plant results that duplicate the pyrolysis step. As seen from the data, the process water from this step contains approximately 2700 ppm of organic carbon and 1040 ppm of phenolics. The data in Example (2) simulates the rehydrating step wherein the waste water is recombined with the dried char from the pyrolysis step, the char is heated, and a certain amount of condensate water is collected. It is seen that the condensate water has only 5 ppm of total organic carbons (TOC) and less than 1 ppm of phenolics. This clearly illustrates that the organic and phenolic contaminants have been strongly recombined with the char. The data in Example (3) illustrates the rehydrated char being leached with distilled water wherein the leachate water contains only 32 ppm of organic compounds and 0.3 ppm of phenolics. This illustrates that the organic components once recombined with the char remain in the char and will not be leached out by being subjected to rainfall or similar water leaching processes. The small amount of organic compounds and phenolics that are leached out are not substantially different than that which would be leached out from the coal or solid alone as is illustrated in Example (4). In this Example the unrehydrated char was subjected to a leaching process with distilled water and the leachate water analyzed. It is clear that the organic compounds of 26 ppm is not materially different from the 32 ppm or organic compounds that were obtained in Example (3). Similarly, the phenolics, while slightly less, are not materially less than those in Example (3).

TABLE I

| Example | | Water Analysis TOC (ppm) | Phenolics (ppm) |
|---|---|---|---|
| (1) | Wet Coal $^{heat}$ Char + Oil + Process Water | 2700 | 1040 |
| (2) | Waste Water + $^{heat}$ Dry Char + Condensate Water | 5 | <1 |
| (3) | Waste Water + Char $^{Leach}$ Wet Char + Leachate with distilled water Water | 32 | 0.3 |
| (4) | Char $^{Leach}$ Wet char + Leachate with distilled water Water | 26 | 0.1 |

The foregoing data clearly establishes that the present process disposes of the contaminants in the waste water by recombining them with the char in such a manner that they will not be removed either by normal exposure to air or to rainwater or other leaching processes. The contaminants being combined with the coal will be incinerated when the coal is burned and will be converted to carbon dioxide which can be disposed of in the atmosphere. Thus, the invention provides an economical process by which the subbituminous coal may be economically upgraded and the process water efficiently utilized.

The foregoing description contemplated the process using low rank coals as being a substrate. However, the process may be used with any coal or carbonaceous material as a substrate without departing from the scope of the appended claims.

I claim:

1. A method for producing a stable carbonaceous material or char from a pyrolysis process comprising:

drying coal to remove water from coal;

pyrolyzing the dried coal forming a char to remove any water left in the coal;

collecting the process water from the pyrolyzing step;

pre-cooling the pyrolyzed char with water;

collecting process water from the pre-cooling step;

rehydrating the char with the process water; and post-cooling the char.

2. The method of claim 1 where the temperature of the char produced by pyrolysis is between 700° and 1200° F. after pyrolysis.

3. The method of claim 1 where the char is contacted with oxygen from air as the char is rehydrated and post-cooled.

4. The method of claim 1 wherein the step of rehydrating the char further comprises combining the char with process water containing hydrocarbons that is produced as a result of the pyrolysis or pre-cooling step.

5. The method of claim 1 where the char is rehydrated to between 1 and 15% water by weight.

6. The method of claim 1 where the amount of water added to the char in the rehydration step does not result in free surface moisture on the char and a final step of applying a dust suppression agent is included after the rehydration step.

7. The method of claim 1 wherein the rehydrated char, upon leaching with water, yields a total organic carbon content of the leachate water of less than 50 parts per million and a phenolic content of less than 5 parts per million.

8. A process for utilizing waste water removed from the upgrading of a low rank coal to avoid waste water disposition problems, comprising:

passing the coal through a drying zone to reduce the quantity of surface and pore water of the coal, the coal being maintained in said drying zone at a temperature below the pyrolysis temperature of the coal;

passing dried coal through a pyrolyzing zone to partially pyrolyze the coal forming a char;

collecting water containing hydrocarbons liberated from the dried coal in the pyrolyzing zone;

passing the char through a quenching zone to cool said char with water to a temperature below 500° F.;

collecting the water from the quenching zone;

passing the quenched char through an oxidizing zone; and passing the char from the oxidizing zone to a cooling and rehydrating zone wherein the char is rehydrated with the collected water from the quench zone, said water containing hydrocarbons, so as to reintroduce the hydrocarbons to the char and reduce the amount of hydrocarbons in the water.

9. The process of claim 8 wherein the char is rehydrated with water at a temperature of less than about 170° F.

10. The process of claim 8 wherein the char is cooled to less than about 200° F. when it is discharged from the cooling zone.

11. The process of claim 8 wherein the char is cooled to less than about 100° F. when it is discharged from the cooling zones.

12. A process for treating pyrolyzed coal with a hydrocarbon-rich process waters to form a carbonaceous with an increased the heat content, comprising the steps of:

drying a bed of coal;

pyrolyzing the coal to form a pyrolyzed carbonaceous material;

collecting process water and hydrocarbons released from the coal in the pyrolysis step;

quenching the pyrolyzed carbonaceaous material with water;

collecting the process water from the quenching step;

rehydrating the pyrolyzed carbonaceous material with the collected process water, some of said process water being rich in hydrocarbons released from the bed of coal in the pyrolysis step;

reintroducing hydrocarbons into the pyrolyzed carbonaceous material through the rehydration step; and oxidizing the rehydrated pyrolyzed carbonaceous material.

* * * * *